United States Patent [19]

Fujimori et al.

[11] 4,182,576

[45] Jan. 8, 1980

[54] INK-RIBBON REVERSING DEVICE

[75] Inventors: Kazuyoshi Fujimori; Akio Mitsuishi, both of Shiojiri, Japan

[73] Assignees: Kabushiki Kaisha Suwa Seikosha, Tokyo; Shinshu Seiki Kabushiki Kaisha, Nagano, both of Japan

[21] Appl. No.: 809,352

[22] Filed: Jun. 23, 1977

[30] Foreign Application Priority Data

Jun. 23, 1976 [JP] Japan ..... 51/74156

[51] Int. Cl.[2] ..... B41J 33/44

[52] U.S. Cl. ..... 400/221; 400/219.5

[58] Field of Search ..... 197/160, 161, 162, 163, 197/164, 165; 101/336; 242/67.4

[56] References Cited

U.S. PATENT DOCUMENTS

| | | | |
|---|---|---|---|
| 584,497 | 6/1897 | Eckels | 197/165 |
| 3,026,987 | 3/1962 | Gather | 101/336 X |
| 3,670,981 | 6/1972 | Cavella | 197/162 X |
| 3,854,670 | 12/1974 | Bertolazzi | 197/164 X |
| 3,948,382 | 4/1976 | Nesbitt et al. | 197/165 |
| 3,954,167 | 5/1976 | Kranz et al. | 197/165 |

FOREIGN PATENT DOCUMENTS

| | | | |
|---|---|---|---|
| 1128869 | 5/1962 | Fed. Rep. of Germany | 197/160 |
| 2529055 | 1/1977 | Fed. Rep. of Germany | 197/160 |
| 880607 | 10/1961 | United Kingdom | 197/165 |
| 1088603 | 10/1967 | United Kingdom | 197/162 |
| 1282735 | 7/1972 | United Kingdom | 197/161 |

*Primary Examiner*—Ernest T. Wright, Jr.

*Attorney, Agent, or Firm*—Blum, Kaplan, Friedman, Silberman & Beran

[57] ABSTRACT

An ink-ribbon reversing device for use in a printing machine having an ink-ribbon winding mechanism is provided. The device includes two ink-ribbon spools and associated spool gears mounted on separate spool shafts spaced apart from each other. A drive shaft is positioned between the spool gears with an arm rotatably mounted thereon. A first gear is fixed to the drive shaft. A second gear rotatably mounted on one end of the arm is in engagement with the first gear. One of two actuatable change-over levers abuts the free end of the arm to maintain engagement between the second gear and one spool gear to drive the associated ribbon spool. At the completion of ribbon winding, the change-over lever is displaced, releasing the arm which rotates about the drive shaft to abut the other change-over lever and engage the second gear with the other spool gear to drive the associated ribbon spool. The invention is characterized in that the arm is rotated in one direction by said first gear to provide for the change-over in engagement of the spool gears.

8 Claims, 3 Drawing Figures

INK-RIBBON REVERSING DEVICE

BACKGROUND OF THE INVENTION

This invention relates generally to an ink-ribbon reversing device for use in a printing machine containing an ink-ribbon winding mechanism, and particularly to a ribbon winding mechanism actuated solely by mechanical force. In conventional ink-ribbon reversing devices, an electromagnetic clutch and the like are utilized. These mechanisms are complicated with a large number of parts, resulting in an enlarged device. The cost of manufacture is high due to the number and size of the parts involved. In addition, there are problems with reliability, because electrical defects are apt to occur. Accordingly, it is desirable to use a mechanism actuated solely by mechanical force, wherein the number of parts is reduced, the reliability is increased and the overall cost is lowered.

SUMMARY OF THE INVENTION

Generally speaking, in accordance with the invention, an ink-ribbon reversing device for use in a printing machine containing an ink-ribbon winding mechanism is provided. The device includes a pair of spool gears mounted on two ribbon spool shafts mounted on a base member and separated from each other. Two ribbon spools are mounted on and in engagement with the spool gears. A drive pulley mounted on a drive shaft positioned between the spool gears is engaged with a unidirectional driving pulley. An arm is mounted on the drive shaft above the base and is rotatable about the drive shaft. A first gear is fixedly mounted on the drive shaft in engagement with a second gear mounted on one end of the arm for transmitting power to one of the spool gears. The arm is held in position by engagement with one of two change-over levers. At this time the second gear engages with said one spool gear for imparting winding power to the associated ribbon spool. At the moment of completion of winding on said ribbon spool a projection provided at the end of the ribbon passes through a detection lever causing the first change-over lever to shift and release the arm. The arm rotates in the direction of the driving pulley due to rotational torque applied to said second gear by said first gear until it comes into engagement with the other change-over lever. At this time the second gear is operably coupled to the other spool gear to drive the associated other ribbon spool. This rotation of the arm and reversal of ribbon winding is repeated each time a winding of the ribbon is completed.

Accordingly, it is an object of this invention to provide an improved ink-ribbon reversing device.

Another object of this invention is to provide an improved ink-ribbon reversing device actuatable by mechanical force solely.

A further object of this invention is to provide an improved ink-ribbon reversing device wherein the rotational driving force is unidirectional and continuous.

Still another object of the invention is to provide an improved ink-ribbon reversing device having a simplified mechanism.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWING

For a fuller understanding of the invention, reference is had to the following description taken in connection with the accompanying drawing, in which.

DESCRIPTION OF THE PREFERRED EMBODIMENTS

Figure 1:
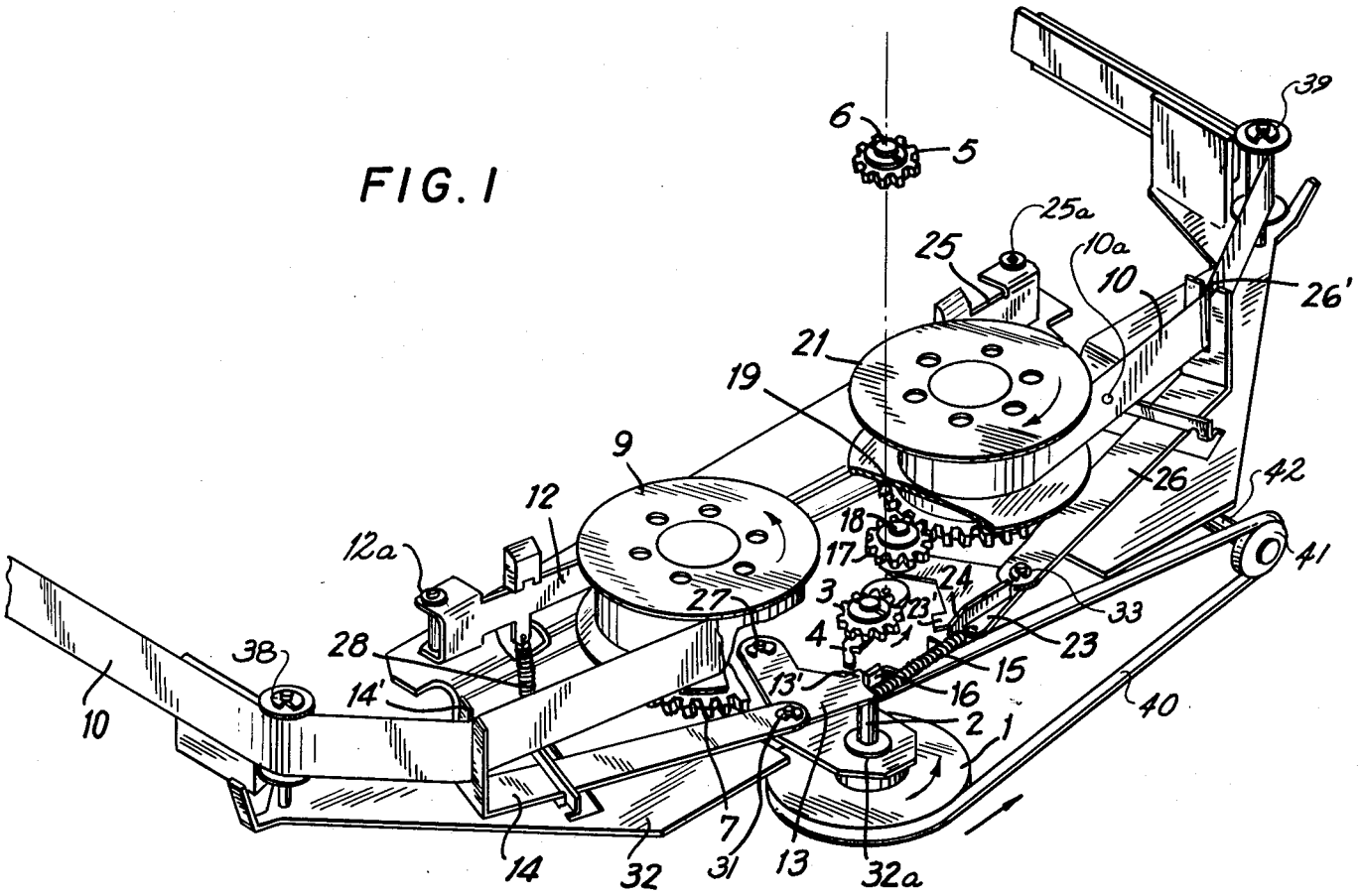
FIG. 1 is a partially exploded perspective view of an ink-ribbon reversing device constructed and arranged in accordance with an embodiment of the instant invention.

Referring now to the drawing, an ink-ribbon winding and reversing device for continuous winding of a ribbon 10 constructed and arranged in accordance with the invention is depicted. Unidirectional dynamic power is transmitted to the device by a drive pulley 1 which is mounted on a drive shaft 2. Drive pulley 1 and drive shaft 2 rotate in the counter-clockwise direction as indicated by the adjacent arrows. Drive pulley 1 is operatively engaged with a motor pulley 41 mounted on a motor shaft 42 by a drive belt 40 for providing power to drive pulley 1. Drive shaft 2 extends through a hole **32*a* in a base 32. An elongated arm 4 is mounted rotatably about drive shaft 2 above base 32. A first gear 3 is fixed to drive shaft 2 above arm 4. A second gear 5 is mounted rotatably on a second gear shaft 6 positioned at an end of arm 4 so that second gear 5 engages first gear 3. A spring clip 30 is provided on second gear shaft 6 to secure second gear 5 in place. Spring clip 30 imparts a frictional braking force between second gear 5 and second gear shaft 6 to cause second gear 5 and arm 4 to rotate around the axis of rotation of first gear 3** as in a planetary/sun gear arrangement.

Figure 2:
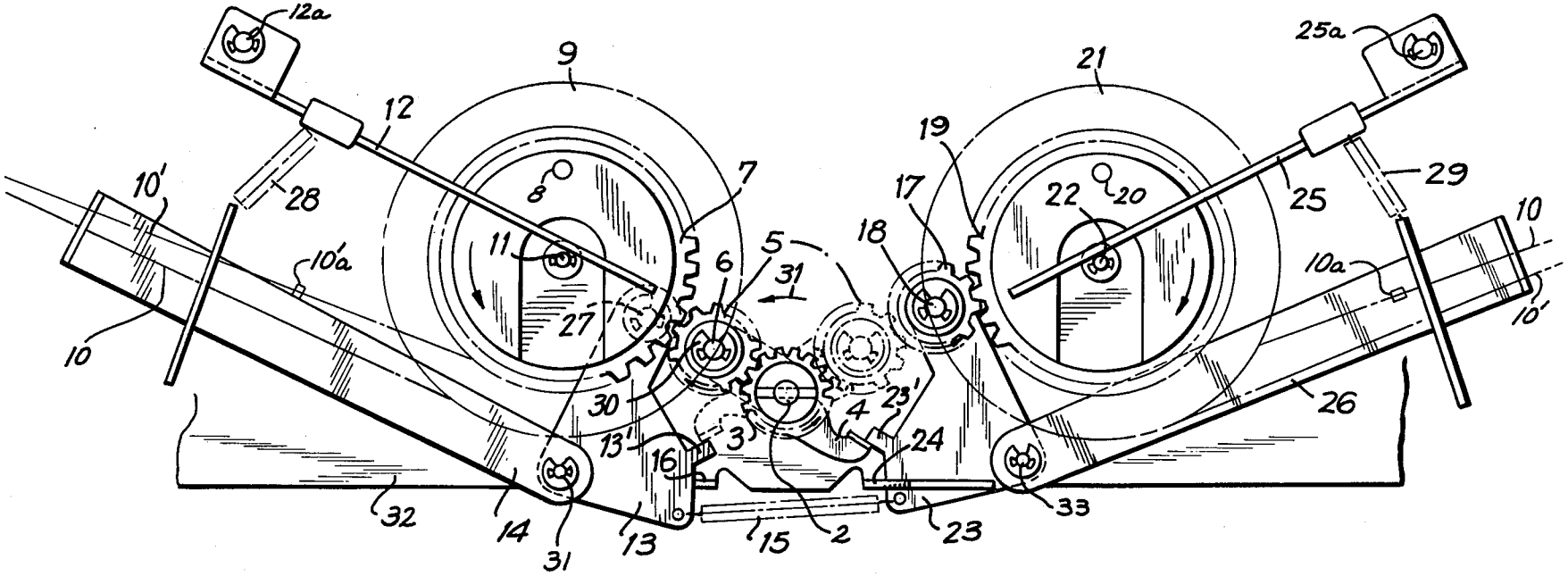
FIG. 2 is a plan view illustrating the operation of the reversing arm of the ink-ribbon reversing device depicted in FIG. 1
Figure 3:
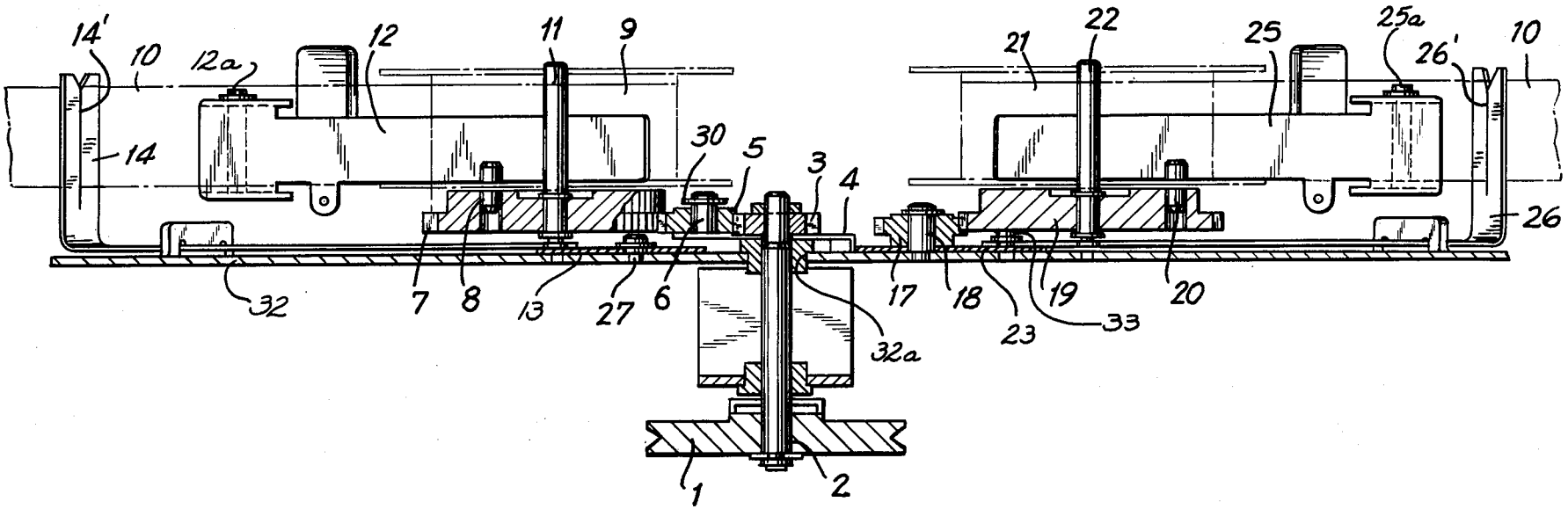
FIG. 3 is an elevational view of the ink-ribbon reversing device depicted in FIG. 1 and FIG. 2.

A first ribbon spool 9 is mounted rotatably on a first ribbon spool shaft 11 and held in engagement with a first ribbon spool gear 7, also mounted on shaft 11, by a first transmission pin 8. First ribbon spool shaft 11 is positioned on base 32 so that ribbon spool gear 7 selectively engages second gear 5. As shown in FIG. 2 and FIG. 3, this is the gear engagement when first ribbon spool 9 is the winding spool. An arrow on first ribbon spool 9 in the counter-clockwise direction indicates the winding direction of first ribbon spool 9. A first retaining lever 12 is provided to prevent first ribbon spool 9 from disengaging with first transmission pin 8. First ribbon spool retaining lever 12 is mounted pivotally on a shaft **12*a* adjacent to first ribbon spool 9 and held biased against first ribbon spool shaft 11 by a first retaining spring 28**.

A second ribbon spool 21, depicted as the feeding spool in FIG. 2 and FIG. 3, is mounted rotatably on a second ribbon spool shaft 22 and held in engagement with a second spool gear 19 by a second transmission pin 20. Second ribbon spool shaft 22 is mounted on base 32 so that second spool gear 19 engages an intermediate gear 17 mounted on an intermediate gear shaft 18 positioned intermediate drive shaft 2 and second ribbon spool shaft 22. Intermediate gear 17 is provided for transmitting power to second spool gear 19 and for permitting second ribbon spool 21 to rotate in the clockwise direction of the arrow shown in FIG. 1 when said second ribbon spool 21 becomes the winding spool after the ribbon winding direction is reversed, despite the fact that first gear 3 always rotates in the same direction. This gear arrangement is shown in phantom in FIG. 2. Shaft 18 is positioned on base 32 so that intermediate gear 17 will engage second gear 5 after a reversal of ribbon winding direction. A second winding spool retaining lever 25 is provided to prevent second ribbon spool 21 from disengaging second transmission pin 20 and ribbon spool gear 19. Second retaining lever 25 is mounted pivotally on a shaft 25*a* and held biased against second ribbon spool shaft 22 by a second retaining spring 29.

A change in direction of spool winding is made by a first change-over lever 13 and a second change-over lever 23. First change-over lever 13 is formed with a projection 13' for engaging the free end of arm 4 to secure the engagement between second gear 5 and intermediate gear 17. This configuration is shown in phantom in FIG. 2 when second ribbon spool 21 is the winding spool. First change-over lever 13 is mounted rotatably on first change-over lever shaft 27 which is mounted on base 32 adjacent first ribbon spool shaft 11. First change-over lever 13 is linked pivotally by a pin 31 to a first detection lever 14, which is formed with a longitudinal slit 14' through which ribbon 10 passes at it is wound on and off first ribbon spool 9 around a first ribbon guide roller 38.

Second change-over lever 23 is mounted rotatably on intermediate gear shaft 18, which also holds intermediate gear 17. Second change-over lever 23 is formed with a projection 23' for engaging the free end of arm 4 to secure engagement between second gear 5 and first ribbon spool gear 7 when first ribbon spool 9 is the winding spool. This configuration is shown in FIG. 2 and FIG. 3. Second change-over lever 23 is linked pivotally by a pin 33 to a second detection lever 26, which is formed with a longitudinal slit 26' through which ribbon 10 passes as ribbon 10 is wound on and off second ribbon spool 21 around a second ribbon guide roller 39.

A return spring 15 connecting first change-over lever 13 and second change-over lever 23 is provided to maintain levers 13 and 23 in their respective at rest positions abutting a first regulating projection 16 and a second regulating projection 24 formed in base 32. Return spring 15 returns change-over levers 13 and 23 to their respective at rest positions after displacement away from arm 4 by respective detection levers 14 and 26.

Operation of the ink-ribbon reversing device may be described as follows starting with first ribbon spool 9 as the winding spool. The unidirectional dynamic power transmitted to drive pulley 1 in the counter-clockwise direction is transmitted by drive shaft 2 to first gear 3 and second gear 5 which rotates in the clockwise direction as viewed in FIG. 2. The free end of arm 4 is engaged by projection 23' of second change-over lever 23 so that second gear 5 engages first ribbon spool gear 7 to impart a counter-clockwise rotational direction as viewed in FIG. 2 to first ribbon spool gear 7 and first ribbon spool 9. Second change-over lever 23 is held against second regulating projection 24 and first change-over lever 13 is held against first regulating projection 16 by return spring 15.

Ribbon 10 is wound on first ribbon spool 9 until a projection 10*a* provided near the end of ribbon 10 unwinding from second ribbon spool 21 reaches slit 26'. At this time, second detection lever 26 is displaced away from drive shaft 2 in the direction of unwinding by the projection 10*a* on ribbon 10. In response to this displacement of second detection lever 26, second change-over lever 23 is rotated about intermediate gear shaft 18 away from arm 4, thereby disengaging projection 23' from arm 4. Arm 4, due to the rotational torque (in the same direction as the rotation of drive shaft 1) imparted by first gear 3 in second gear 5, rotates in the counter-clockwise direction (FIG. 2) until the free end of arm 4 engages projection 13' of first change-over lever 13. During the reversal operation, first change-over lever 13 is maintained in its at rest position against regulating projection 16 by action of return spring 15 which has been biased by displacement of second change-over lever 23.

The rotation of arm 4 disengages second gear 5 from first ribbon spool gear 7 and when the free end of arm 4 abuts first change-over lever 13 at projection 13', second gear 5 engages intermediate gear 17 which is in engagement with second ribbon spool gear 19. This engagement of second gear 5, intermediate gear 17 and second ribbon spool gear 19 transmits power through second transmission pin 20 to second ribbon spool 21 thereby imparting a clockwise rotation to second ribbon spool 21 which now becomes the winding spool. Second change-over lever 23 returns to position abutting regulating projection 24 by force from return spring 15.

Second ribbon spool 21 remains the winding spool until a second projection 10'*a* near the end of ribbon shown as 10' unwinding from first ribbon spool 9 engages first detecting lever 14. At this time first change-over lever 13 is displaced away from drive shaft 2 freeing arm 4. Arm 4 rotates until it engages second change-over lever 23 at projection 23' thereby causing another reversal of winding direction. This reversal of winding direction occurs each time the winding of ribbon 10' is completed.

Accordingly, the instant invention is characterized by an improved ink-ribbon reversing device which reverses the winding direction of a winding ribbon by the actuation of changeover levers which free a rotating arm from engagement with one ribbon spool gear and into engagement with the other ribbon spool gear. The winding power is unidirectional and continuous and provides the power to rotate the arm in the same direction, thereby providing a simplified mechanism. Additionally, the absence of any electrical equipment insures an increase in reliability of the ribbon reversing device.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An ink-ribbon winding reversing device, comprising:

a first and a second ribbon spool shaft spaced apart from each other;

a first and a second ribbon spool rotatably mounted on said respective spool shafts;

gear means for transmitting power to said ribbon spools;

a drive shaft positioned between said spool shafts;

drive means for transmitting power to said drive shaft;

an arm rotatably mounted on said drive shaft;

a first gear fixed to said drive shaft;

a second gear rotatably mounted at one end of said arm in engagement with said first gear for transmitting power to said ribbon spool gear means;

actuable change-over means including a first change-over lever selectively engageable with the second end of said arm for holding said arm in position to drive one of said ribbon spools for winding until winding of said one spool is complete and a second change-over lever selectively engageable with the second end of said arm for holding said arm in position to drive the otherof said ribbon spools; wherein each said change-over lever is formed with a projection for engaging said arm to insure engagement between said second gear on said arm and said ribbon spool gear means;

detection means for actuating said change-over means at completion of winding of one ribbon spool, whereby said arm is released from engagement with one of said change-over levers and is rotated until engaged by the other of said change-over levers so that the other ribbon spool becomes the winding spool; and said detection means includes a first and a second detection lever pivotally secured to said respective change-over levers, each detection lever being selectively displaceable away from said drive shaft whereby said arm is freed for rotation from engagement with one of said change-over levers.

2. The device of claim 1, wherein said device further includes a base and said change over means further includes a first and second engaging projection formed on said base and a biasing means for returning said change-over levers to their respective at rest positions abutting said engaging projections on said base.

3. The device of claim 2, wherein said biasing means comprises at least one spring.

4. The device of claim 2, wherein said biasing means comprises a spring connecting both said change-over levers to each other.

5. The device of claim 4, including a ribbon fixed at each end to said spools, said ribbon having ribbon projections thereon proximate the ends thereof wherein said detection levers are each formed with a slit for said ribbon to pass therethrough so that one of said ribbon projections on said unwinding ribbon will deflect said detection lever in the direction of said unwinding ribbon whereby said change-over lever in engagement with said arm will be displaced and free said arm to rotate about said drive shaft until said arm engages the other change-over lever.

6. The device of claim 5, wherein said ribbon spool gear means comprises a first and a second ribbon spool gear rotatably mounted on said respective ribbon spool shafts and means for engaging ribbon spool gears and said ribbon spools.

7. The device of claim 6, wherein said first ribbon spool shaft is positioned so that said first ribbon spool gear will be in selective engagement with said second gear on said arm, and said ribbon spool gear means further includes an intermediate gear rotatably mounted and positioned to be in engagement with said second spool gear and selectively engaged with said second gear on said arm.

8. The device of claim 7, wherein said drive shaft is rotated in one direction only.

* * * * *